US006261390B1

(12) United States Patent
Yeh et al.

(10) Patent No.: US 6,261,390 B1
(45) Date of Patent: Jul. 17, 2001

(54) PROCESS FOR NODULIZING SILICON IN CASTING ALUMINUM SILICON ALLOYS

(76) Inventors: Hsien-Yang Yeh, 2037 Dawn St., Lomita, CA (US) 90717; Hen-Geul Yeh, 4865 Linaro Dr., Cypress, CA (US) 90630; Ru-Yao Wang; Wei-Hua Lu, both of 32, 220th Lane, Rm. 402, An-shen Rd., Shanghai 200051 (CN)

( * ) Notice: Subject to any disclaimer, the term of this patent is extended or adjusted under 35 U.S.C. 154(b) by 0 days.

(21) Appl. No.: 09/570,631

(22) Filed: May 15, 2000

(51) Int. Cl.[7] ..... C22F 1/043; B22D 27/20
(52) U.S. Cl. ..... 148/549; 164/66.1; 164/57.1
(58) Field of Search ..... 164/66.1, 57.1; 148/549

(56) References Cited

U.S. PATENT DOCUMENTS 2,654,670 * 10/1953 Davis et al. ..... 75/68
3,415,305 * 12/1968 Schrieber et al. ..... 164/57
3,634,075 * 1/1972 Hoff ..... 75/135
3,849,123 * 11/1974 Webster, Jr. ..... 75/138
4,434,014 * 2/1984 Smith ..... 148/3
6,044,897 * 4/2000 Cross ..... 164/473
6,132,532 * 10/2000 Shepelev et al. ..... 148/549

FOREIGN PATENT DOCUMENTS

3208702-A1 * 9/1983 (DE) .
60-245737 * 5/1984 (JP) .

* cited by examiner

*Primary Examiner*—George Wyszomierski
*Assistant Examiner*—Janelle Combs-Morillo
(74) *Attorney, Agent, or Firm*—Monty Koslover

(57) ABSTRACT

A method for nodulizing silicon crystals in casting Aluminum-(8–12%)Silicon alloys is described. An initial alloy melt is refined by addition of a master alloy containing elements of titanium, phosphorous, boron, zirconium and rare earths to the initial molten alloy, and then through conventional heat treatment and aging. Testing the alloys shows that the nodulized silicon crystals are blunted in shape and well distributed, resulting in a high resistance to wear and high ultimate tensile strength at room temperature and at 300 deg. C. Machinability of the Al-Si alloys is also greatly improved by the process.

5 Claims, 4 Drawing Sheets

HYPEREUTECTIC Al-Si ALLOY;
22% Si

EUTECTIC Al-Si ALLOY

HYPEREUTECTIC Al-Si ALLOY; 18% Si

HYPEREUTECTIC Al-Si ALLOY; 22% Si

MECHANICAL PROPERTIES OF TESTED Al-Si ALLOYS

| Alloy: | | Al12SiCuMg | Al22SiCuMg |
|---|---|---|---|
| Casting Method: | | Permanent Mold | |
| Tensile Strength | (Mpa) | | |
| 20°C | | 280-330 | 260-290 |
| 300°C | | 90-100 | 90-100 |
| Elongation | (%) | | |
| 20°C | | 1.0-1.5 | $\nless$ 0.5 |
| 300°C | | 9.0-13.0 | 1.0-3.0 |
| Endurance Limit | (Mpa) | | |
| 20°C | (n-$10^7$) | 130 | 110 |
| Hardness | | | |
| 20°C | (HB) | 90-110 | 110-130 |
| Loss of weight in wear | | | |
| (relative)* | | 0.4 | 0.4 |
| Friction Coefficient | | 0.08 | 0.11-0.14 |
| Dimensional Stability | (%) | 0.015 | 0.004 |

*Assume the loss wear in weight for conventional eutectic Al-Si alloy is 1.0

FIG. 7

PROCESS FOR NODULIZING SILICON IN CASTING ALUMINUM SILICON ALLOYS

BACKGROUND OF THE INVENTION

1. Field of the Invention

This invention relates to methods of casting Aluminum-Silicon alloys and more particularly, to a process for nodulizing silicon crystals in the casting of Al-Si alloys.

2. Background

The eutectic Al-Si alloy as conventionally cast, is an excellent wear-resistant light metal which is widely used for moving and easily worn-out parts in automobiles, airplanes and spacecraft. However, there has long been an industry need for Al-Si alloys having better resistance to wear coupled with higher tensile strength and other improved mechanical properties. This improvement is required particularly to meet present day demands of equipment such as automobile engines and aircraft mechanical controls, as well as for many industrial fabrication applications.

In pursuit of this need, over the past several decades, metallurgists have paid much attention to AL-Si alloys, particularly to the effects achieved by varying the alloy silicon content. When an increase is made in its silicon content, the alloy resistance to wear rises. However, the silicon crystals tend to become coarse and angular, which leads to a weakening of the alloy's mechanical properties, particularly ductility, castability and machinability of the alloy. To overcome the problems associated with increased silicon content, metallurgists in several countries have investigated methods of refining the silicon crystals in the alloy in order to improve the properties and microstructure of the Al-Si alloy, and further to obtain nodular silicon.

In the 1950's and 1960's decades, many different impurities such as Na, Sr, rare earth elements (RE) and others or their combination, were added to the molten Al-Si alloy prior to casting in attempts to obtain nodular silicon crystals in eutectic or hypereutectic alloys. These efforts were not successful, resulting in a poor quality Al-Si alloy having a tendency toward porosity and being unsuitable for industry.

Other methods have been tried to nodulize silicon crystals in a eutectic Al-Si alloy (Si<12%) at high temperatures near the melting point. However, this approach produced only coarseness and clusters of nodular silicon. It was found that high temperatures will not nodulize or blunt the primary silicon crystals, and the effort was dropped as being unsuccessful.

Of late, several patents to improve the quality of high-silicon (hypereutectic) Al-Si alloys have been issued. Although these patented Al-Si alloys offer generally better properties than existing conventional high-silicon alloys, their silicon crystal morphology exhibits an angular form and tends to be clustered, not favoring wear resistance, so improvement is marginal at best in a critical. characteristic such as wear.

Therefore, there remains an important industrial need for a process for nodulizing silicon in casting aluminum-silicon alloys that will produce alloys having significantly improved mechanical properties of resistance to wear, tensile strength, low porosity and machinability coupled with low cost.

SUMMARY OF THE INVENTION

A process for nodulizing the silicon crystals in casting aluminum-silicon (Al-Si) alloys is described, together with test results of the produced alloys. An Al-Si allay melt is to be refined by the addition of small percentages of P, rare earth elements (RE), Ti, Zr and B in a master form or in salt bearing elements, heating at a low temperature to nodulize the silicon crystals, and solution treatment and aging. The resulting silicon crystal becomes spheroidal in shape and formed primary silicon crystal nodules are blunted and well distributed. Test results of nodular silicon eutectic and hypereutectic Al-Si alloys show a significantly higher ultimate tensile strength for the alloys at room temperature and at 300 degrees C., and greatly improved resistance to wear compared with conventionally produced Al-Si alloys.

Accordingly, it is a principal object of this invention to provide a method of nodulizing silicon in aluminum-silicon alloys that will produce alloys having the greatly improved mechanical properties needed by industry.

A major advantage of this invention process is that the silicon crystals in Al-Si alloys can be spheroidised without clustering.

Further objects and advantages of the invention will be apparent from studying the following portion of the specification, the claims and the attached drawings.

BRIEF DESCRIPTION OF THE DRAWINGS

FIG. 7 is a table showing the mechanical properties of eutectic and hypereutectic Al-Si alloys produced according to the present invention.

DESCRIPTION OF THE PREFERRED EMBODIMENT

Figure 1:
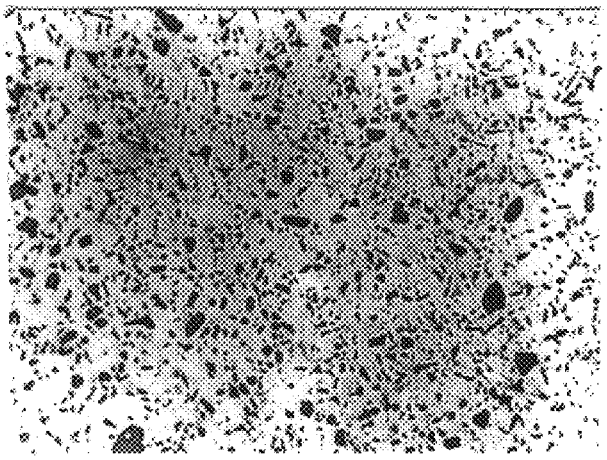
FIG. 1 is a photomicrograph of a eutectic Al12Si alloy (12% by weight silicon) that was produced by this invention process, particularly showing the wide distribution of silicon crystal nodules.

As was described above, it is extremely advantageous to be able to produce hypoeutectic, eutectic and hypereutectic Al-Si casting alloys having well distributed nodular eutectic silicon and blunted primary silicon, and which have good castability, machinability and greatly improved mechanical characteristics, particularly high resistance to wear.

The present invention process overcomes the disadvantages of the techniques presently in use, wherein the nodulization of eutectic silicon as well as refinement and blunting of primary silicon are performed in a single step at a high temperature. In the present invention process, two major steps are employed: First, the addition of a master alloy with combined elements to the Al-Si melt; second, heating the mixture at a low temperature to nodulize the silicon, avoiding coarsening and clustering of the silicon crystals.

The invention method for nodulizing the silicon in Al-Si alloy casting, for Al-Si alloys having a silicon content of 8.0 to 23%; the alloys also including amounts of copper, magnesium, and iron, comprises the following process steps:

a) heat a selected start Al-Si alloy amount in a graphite crucible in an electrical resistance furnace to the start alloy liquidus temperature, producing a melt;

b) add a master alloy mixture into the melt at a master alloy temperature of 150 deg. C above the start alloy liquidus temperature, using a master alloy mixture composition of Al-Ti 1–10% weight titanium and 90–99% weight aluminum; Al-B 0.2–3.0% weight boron and balance aluminum; Al-RE 4.0–10% weight rare earth elements and 90–96.0% weight aluminum; Al-Zr 1.0–5.0% weight zirconium and the balance aluminum; and Cu-P 5.0–8.0% weight phosphorous and 92.0–95.0% weight copper, stirring the added mixture in the melt and holding for a short time;

c) degas the melt with nitrogen, forming a treated molten;

d) pour and cast the treated molten into a mold, forming a casting of a new alloy;

e) treat the casting in solution by the following steps:

(1) heat the casting at a temperature of 500–530 deg. C. and hold that temperature for 6–8 hours causing dissolution of Cu,Mg,Ni and other elements in the Al matrix and obtaining a solid solution Al-Si alloy; and (2) quench the new Al-Si alloy casting at high temperature into water; and f) age the new Al-Si alloy casting by heating at a temperature of 130–230 deg. C. for 6–9 hours, to obtain the desired alloy mechanical characteristics.

In selecting the added element amounts in the master alloy mixture, it is important to make the selection so that a chemical analysis of an alloy casting produced by the foregoing process includes a particular amount of these elements. This amount has been established as being 0.005–0.1% phosphorous, 0.03–0.30% mixed rare earth elements, 0.02–0.30% titanium, 0.001–0.10% boron and 0.02–0.10% zirconium by weight. This modifier element contribution has been found to produce the optimum alloy mechanical characteristics, particularly with regard to wear resistance.

The following comments apply to the foregoing procedure steps:

In step a), the start alloy, which is the initial alloy to be modified, will have a liquidus temperature depending upon its chemical composition. For the range of Al-Si alloys to which the above process applies, the liquidus temperature has a range of 700–830 deg. C. and would be known and selected by the engineer.

In step b), the overall weight of the added master alloy components is about 3% the weight of the molten. The exact amount of Ti, B etc. is selected by the engineer depending on the weight and composition of the start alloy molten, to achieve the final required chemical composition of elements added by the modifier, in the resulting new Al-Si alloy.

Instead of using metallic master alloys, master alloys may be added into the melt in the form of salt bearing elements as a matter of convenience. These would include titanium alkali-fluoride, alkali boron fluoride, zirconium alkali-fluoride, rare earth chloride, and phosphide. The percentage Ti, B, Zr, RE and P contained therein would be the same as listed above for the metallic master alloy.

An alternative master alloy that may be used comprises: Al-Ti 1–10% weight titanium and 90–99% weight aluminum; Al-B 0.2–3.0% weight boron and balance aluminum; Al-RE 4.0–10% weight rare earth elements and 90–96.0% weight aluminum; Al-Zr 1.0–5.0% weight zirconium and balance aluminum, and incidental impurities. The foregoing weights of Ti,B,RE, and Zr may instead be added in the form of salt bearing elements as described above.

In step f), a heat aging of the Al-Si alloy casting obtained by quenching is necessary to raise the strength of the alloy to meet given requirements which vary for different composition Al-Si alloys and their application. Thus, the heating temperature and holding time vary over a range, and are selected depending on the desired alloy characteristics.

The foregoing procedure for the nodulizing of silicon crystals in Al-Si alloys is thus seen to differ from the current conventional procedures primarily by two major features; the adding of a certain master alloy mix to the start melt before pouring, and the subsequent lower temperatures of heat treating the casting. These two features make it possible to achieve the nodulizing of the silicon crystals and their distribution without clustering, that is required to obtain the desired improvement in Al-Si alloy mechanical strength and wear resistance.

To demonstrate the practicality and results of using the nodulizing method, a number of eutectic and hypereutectic Al-Si alloys were produced using the forgoing procedure and their mechanical characteristics tested. A brief description of two examples of these alloy productions and a short summary of their test results is now presented:

EXAMPLE 1

For the initial melt, a number of eutectic Al-Si alloys were produced, having a composition with the following ranges: 11.0–13.0% Si, 0.8–1.5%Cu, 0.6–1.0% Mg, <0.5% Mn, and <0.7% Fe. Each alloy melt was prepared in a crucible and metallic master alloys including Al-Ti, Al-B, Al-RE, Al-Zr and Cu-P were added into the melt at 700–720 deg. C. The melts were then degassed with nitrogen. After stirring and holding for 15 minutes, the treated moltens were poured and cast followed by heat treatment, solid solution and aging treatments to produce a new Al-Si alloy casting.

Figure 4A:
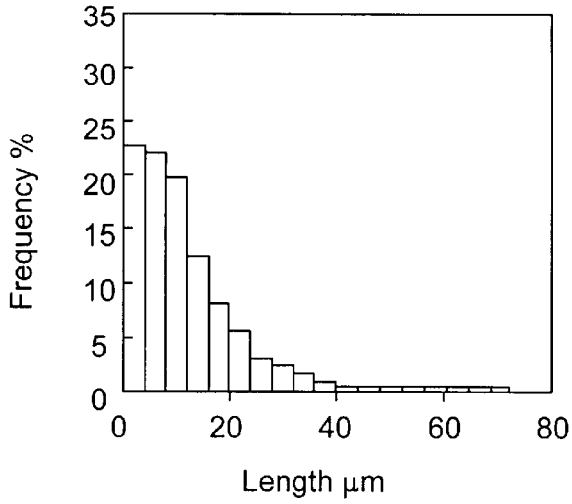
FIGS. 4A, 4B and 4C are graphs showing the variety of length, breadth and average aspect ratio 1/b of silicon nodular crystals in the eutectic Al-Si alloy shown in the FIG. 1 photomicrograph.
Figure 4B:
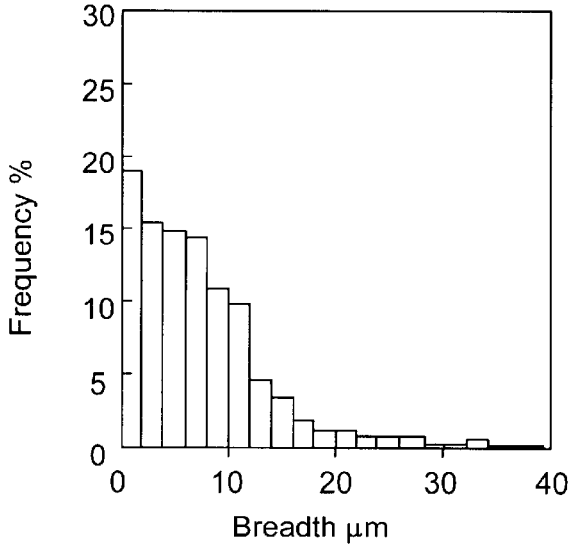
Figure 4C:
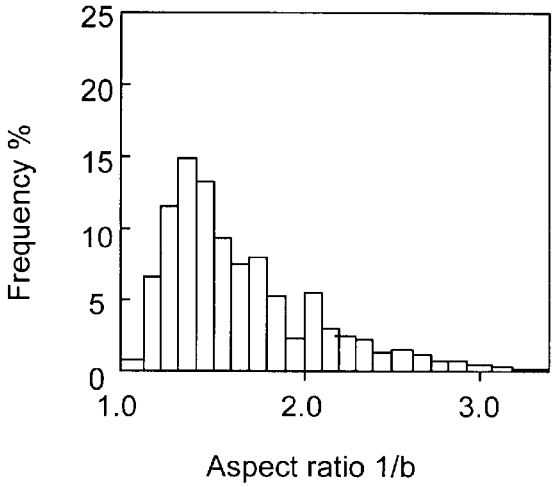

Refer now to FIG. 1, which is a photomicrograph of a eutectic Al12Si alloy (12% by weight silicon) that was produced by this invention process. The alloy has nodular eutectic silicon crystals well distributed throughout the matrix. This produces excellent mechanical properties, particularly in wear resistance. The shapes of the silicon nodules are clearly blunted. This aspect is quantified in the graphs of FIGS. 4A, 4B and 4C. These graphs show the variety of lengths, breadths and the average aspect ratio 1/b of the silicon nodular crystals shown in FIG. 1 vs their % frequency of occurrence. Approximately 70% of the nodules had an aspect ratio 1/b between 1.6 and 1.9 indicating a high degree of blunting.

Figure 5:
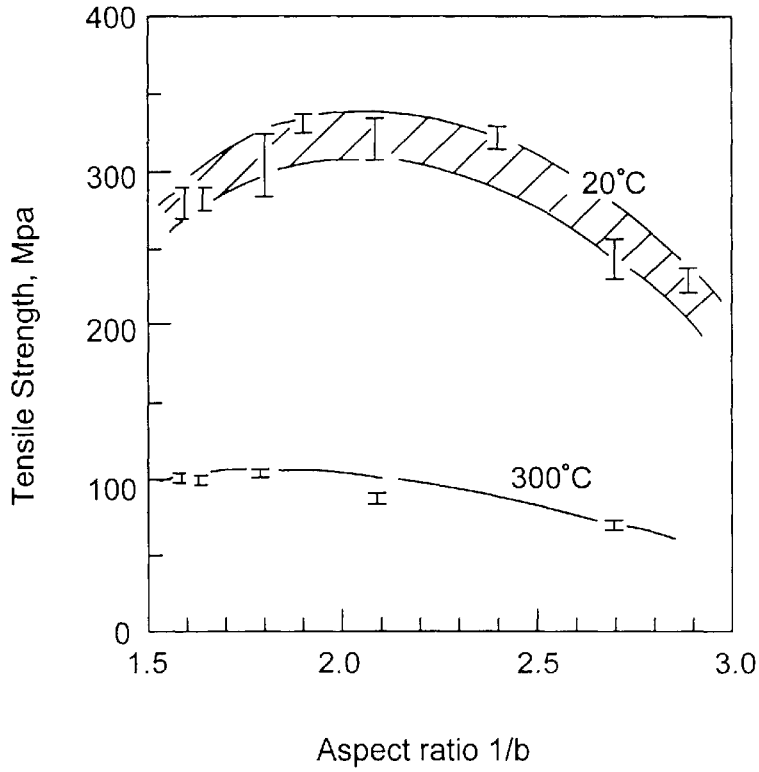
FIG. 5 is a graph showing the effect of silicon crystal aspect ratio on Al-Si alloy ultimate tensile strength at 20 deg. C and at 300 deg. C. temperatures.

Refer now to FIG. 5 which plots the results of tensile strength tests performed on produced Al-Si alloys which had most nodulized Si crystals in a aspect ratio range of 1.5 to 2.8. An aspect ratio between 1.5 and 1.9 corresponds to the highest levels of tensile strength at alloy temperatures of 20 deg. C. and at 100 deg. C.

EXAMPLE 2

For the initial melt, a number of hypereutectic Al-Si alloys were produced, having a composition with the following ranges: 18.0–23.0% Si, 0.8–1.6% Cu, 0.6–1.0% Mg, <0.5% Mn, and <0.7% Fe. Each alloy melt was prepared in a crucible and metallic master alloys including Al-Ti, Al-B, Al-RE, Al-Zr and Cu-P were added into the melt at 850 deg. C. to achieve the desired levels of titanium, boron, rare earth and phosphorous in the final Al-Si alloy. The melts were then degassed with nitrogen. After stirring and holding for 15 minutes, the treated moltens were poured at 820 deg. C. and cast, followed by heat treatment, solid solution and aging treatments to produce new Al-Si alloys.

Figure 2:
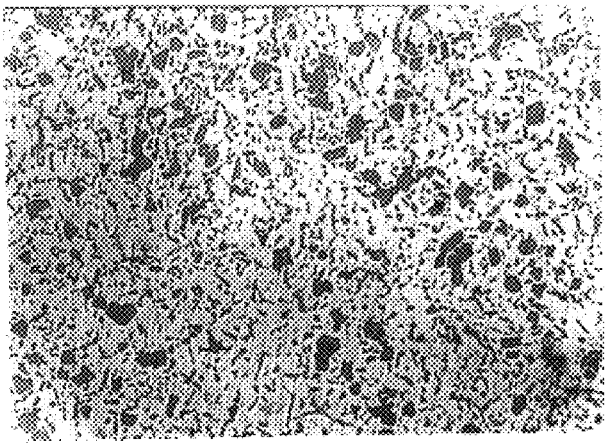
FIG. 2 is a photomicrograph of a hypereutectic Al18Si alloy (18% by weight silicon) that was produced by this invention process.
Figure 3:
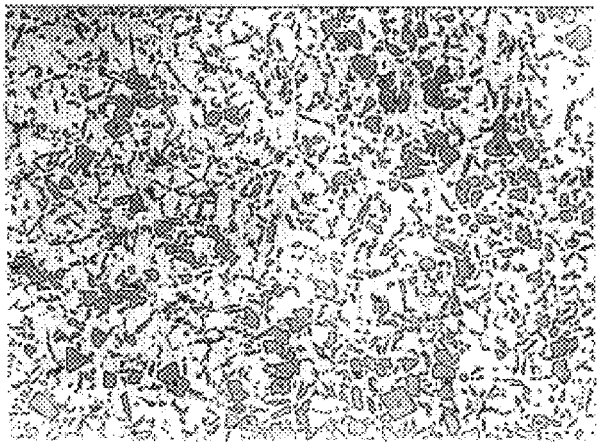
FIG. 3 is a photomicrograph of a hypereutectic Al22Si alloy (22% by weight silicon) that was produced by this invention process.
Figure 6:
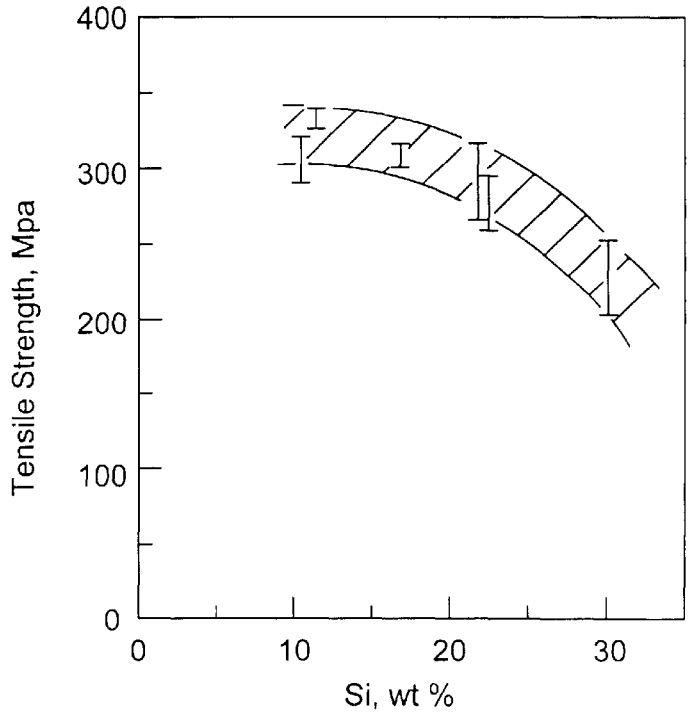
FIG. 6 is a graph showing the ultimate tensile strength of eutectic and hypereutectic Al-Si alloys versus alloy silicon content, for Al-Si alloys produced according to the present invention.

Refer now to FIGS. 2 and 3 which are photomicrographs of respectively, a hypereutectic Al-Si alloy with 18% silicon content and a hypereutectic Al-Si alloy with 22% silicon content. In both micrographs, the nodulized silicon crystals are well distributed and blunted, indicating a good resistance to wear characteristic . The average nodule aspect ratio is somewhat higher than for the eutectic Al-Si alloys, but results in an alloy ultimate tensile strength only a little below the eutectic alloy strength at 20 deg. C. This is shown in FIG. 6 which plots the range of measured ultimate tensile strength vs percent silicon content for the tested alloys referred to above.

A table of the tested and measured mechanical properties of eutectic Al-Si (12% Si) and hypereutectic Al-Si (22% Si) alloys which were produced using the invention process, is presented in FIG. 7. It is apparent that alloy resistance to wear is greatly improved, having about 60% less wear compared to conventionally produced Al-Si alloys.

The ultimate tensile-strength at 20 deg C. and at 300 deg. C. is 30% higher than conventional Al-Si alloys with a similar composition, lending itself to possible new alloy applications requiring high tensile strength and endurance.

The machinability of the new alloys is greatly improved as evidenced by the ductility and hardness characteristics, In the hypereutectic test samples, which would normally have angular shaped silicon crystals that worsen machinability, nodular silicon crystal replace angular silicon and the alloy machinability is greatly improved and can be machined by a hard metal tool. At a silicon level less than 16%, the new alloy has very good machinability.

Regarding castability of the alloys, an examination of the cast tested alloys found few defects such as porosity, pin-holes and shrinkage, which are regularly found in conventional hypereutectic Al-Si alloys. Thus, complex castings such as cylinder heads and blocks can be cast of the new alloys, which represents an advance in automobile engine manufacturing techniques of considerable significance for cost and weight reduction.

Finally, it should be understood that the elements used for the added master alloy are commonly used in foundries and are not expensive. It is easy to produce the metallic master alloy comprising the five elements. The melting point of the master alloy at about 650 deg. C. is much lower than the melting temperature of the new alloy. Also, the amount of master alloy added is about 3% or less of the molten weight, making it easy to-add the master to the molten alloy, with no pollution or smoking problems.

In view of its generally excellent qualities as described above, combined with a low cost and simple technology, It is anticipated that many automobile manufacturers will be interested in using the aluminum alloys that can be produced by this invention process.

From the foregoing description, changes and various modifications may be apparent to those skilled in the art. These alternatives and modifications are considered to be within the spirit and scope of the present invention.

Having described the invention, what is claimed is:

1. A method for nodulizing the silicon in Al-Si alloy castings having a silicon (Si) content in the range of 8.0–23.0%, which comprises the steps of:

a) heating a selected start Al-Si alloy mass to its alloy liquidus temperature, producing a melt;

b) adding a master alloy mixture into the melt at a master alloy temperature of 150 deg. C above the start alloy liquidus temperature, said master alloy mixture comprising: Al-Ti 1–10% weight titanium and 90–99% weight aluminum; Al-B 0.2–3.0% weight boron and balance aluminum; Al-RE 4.0–10% weight rare earth elements and 90–96.0% weight aluminum; AI-Zr 1.0–5.0% weight zirconium and the balance aluminum; and Cu-P 5.0–8.0% weight phosphorous and 92.0–95.0% weight copper; stirring the master alloy mixture in the melt and holding for a short time period;

c) degassing the melt with nitrogen and forming a treated molten mass;

d) pouring and casting the treated molten mass, producing a casting;

e) treating the casting further in solution by the following steps:

(1) heating the casting at a temperature of 500–530 deg. C. and holding that temperature for 6–8 hours, causing dissolution of Cu,Mg,Ni and other elements in the Al matrix and obtaining a solid solution Al-Si alloy; and (2) quenching the solid solution alloy casting at high temperature into water; and f) aging the new Al-Si alloy casting by heating at a temperature of 130–230 deg. C. for 6–9 hours.

2. The method as recited in claim 1, wherein the added master alloy mixture comprises: titanium alkalifluoride K2Ti(1–10%)F6, alkali boron fluoride KB(0.2–3.0%)F4, zirconium alkalifluoride KZr(1.0–5.0%)F6, rare earth chloride RE(4.0–10%)C13, and phosphide P(5.0–8.0%).

3. The method as recited in claim 1, wherein the added master alloy mixture comprises: Al-Ti 1–10% weight titanium and 90–99% weight aluminum; Al-B 0.2–3.0% weight boron and balance aluminum; Al-RE 4.0–10% weight rare earth elements and 90–96.0% weight aluminum; AI-Zr 1.0–5.0% weight zirconium and the balance aluminum and incidental impurities.

4. The method as recited in claim 1, wherein the added master alloy mixture comprises: titanium alkalifluoride K2Ti(1–10%)F6, alkali boron fluoride KB(0.2–3.0%)F4, zirconium alkalifluoride KZr(1.0–5.0%)F6, rare earth chloride RE(4.0–10%)C13 and incidental impurities.

5. The method as recited in claim 1, further comprising: selecting the quantities of the elements comprising the master alloy mixture in a manner to produce added elements in the final, cast Al-Si alloy in the amounts by percent weight of 0.005–0.1% phosphorous, 0.03–0.30% mixed rare earth elements, 0.02–0.30% titanium, 0.001–0.10% boron and 0.02–0.10% zirconium.

* * * * *

UNITED STATES PATENT AND TRADEMARK OFFICE
Certificate

Patent No. 6,261,390 B1 Patented: July 17, 2001

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Ru-Yao Wang, 32, 220th Lane, Rm. 402, An-shen Road, Shanghai 200051(CN); and Wei-Hua Lu, 32, 220th Lane, Rm. 402, An-shen Road, Shanghai 200051(CN)

Signed and Sealed this Eighth Day of January 2002.

ROY V. KING
*Supervisory Patent Examiner*
Art Unit 1742

UNITED STATES PATENT AND TRADEMARK OFFICE

CERTIFICATE OF CORRECTION

PATENT NO. : 6,261,390 B1 
DATED : July 17, 2001
INVENTOR(S) : Ru-Yao Wang et al.

It is certified that error appears in the above-identified patent and that said Letters Patent is hereby corrected as shown below:

Title page,
Item [57], ABSTRACT,
Line 2, replace "Aluminum-(8-12%)Silicon" with -- aluminum-(8-12%)silicon --

Drawings,
FIG. 5, Sheet 3, at the top of the box insert -- EUTECTIC Al-Si --
FIGS. 5 & 6, Sheet 3, after "Tensile Strength" change "Mpa" to -- MPa --
FIG. 7, Sheet 4, after "Tensile Strength" and "Endurance Limit" change "(Mpa)" to -- MPa -- (both occurrences)
FIG. 7, Sheet 4, under "Endurance Limit" replace "(n-$10^7$)" with -- (N=$10^7$) --

Column 1,
Lines 7-8, replace "Aluminum-Silicon" with -- aluminum-silicon --
Line 22, replace "AL-Si" with -- Al-Si --
Line 55, before "improvement" insert -- that any --
Line 66, replace "allay" with -- alloy --

Column 2,
Line 24, replace "Al12Si" with -- Al-12Si --
Line 28, replace Al18Si" with -- Al-18Si --
Line 32, replace "Al22Si" with -- Al-22Si --

Column 4,
Line 25, replace "forgoing" with -- foregoing --
Line 42, replace "Al12Si" with -- Al-12Si --
Line 57, replace "a aspect" with -- an aspect --
Line 60, replace "100 deg. C." with -- 300 deg. C. --

Column 5,
Lines 2-3, replace "rare earth and phosphorous" with -- rare earth, zirconium and phosphorus --
Line 32, replace "characteristics," with -- characteristics. --
Line 54, replace "to-add" with -- to add --
Line 57, replace "technology, It" with -- technology, it --

UNITED STATES PATENT AND TRADEMARK OFFICE

CERTIFICATE OF CORRECTION

PATENT NO. : 6,261,390 B1
DATED : July 17, 2001
INVENTOR(S) : Ru-Yao Wang et al.

It is certified that error appears in the above-identified patent and that said Letters Patent is hereby corrected as shown below:

Column 6,
Line 17, replace "AI-Zr" with -- Al-Zr --

Signed and Sealed this

Twenty-ninth Day of June, 2004

JON W. DUDAS
*Acting Director of the United States Patent and Trademark Office*